US006267623B1

(12) United States Patent
Hisamatsu

(10) Patent No.: US 6,267,623 B1
(45) **Date of Patent: *Jul. 31, 2001**

(54) ELECTRICAL CONNECTOR WITH A MATING PORTION DEFINED BY A METALLIC SHELL

(75) Inventor: Kazuhito Hisamatsu, Hino (JP)

(73) Assignee: Japan Aviation Electronics Industry, Limited, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/165,335

(22) Filed: Oct. 1, 1998

(30) Foreign Application Priority Data

Oct. 3, 1997 (JP) ..... 9-271678

(51) Int. Cl.[7] ..... H01R 9/03
(52) U.S. Cl. ..... 439/607; 439/609; 439/610
(58) Field of Search ..... 439/607, 608, 439/609, 610, 108, 92, 901, 78, 79

(56) References Cited

U.S. PATENT DOCUMENTS

| | | | | |
|---|---|---|---|---|
| 5,209,677 | * | 5/1993 | Bricaud | 439/607 |
| 5,273,459 | * | 12/1993 | Davis | 439/607 |
| 5,591,050 | * | 1/1997 | Sueoka | 439/607 |
| 5,603,639 | * | 2/1997 | Lai et al. | 439/607 |
| 5,674,085 | * | 10/1997 | Davis et al. | 439/188 |
| 5,713,746 | * | 2/1998 | Olson et al. | 439/79 |

* cited by examiner

*Primary Examiner*—Gary Paumen
*Assistant Examiner*—Alexander Gilman
(74) *Attorney, Agent, or Firm*—Laff, Whitesel & Saret, Ltd.; J. Warren Whitesel

(57) ABSTRACT

In an electrical connector to be surface-mounted on a printed circuit board, which comprises an insulator body, a plurality of contacts fixed to the insulator body, and a metallic shell fitted on the insulator body, the contacts having contact portions in a mating hole for receiving a mating plug connector, the insulator body is formed with a pair of pillars extending in parallel with the contacts for supporting the metallic shell. The mating hole is defined by the metallic shell supported by the pillars so that the contacts are enclosed directly by the metallic shell without insulator walls therebetween.

4 Claims, 3 Drawing Sheets

ELECTRICAL CONNECTOR WITH A MATING PORTION DEFINED BY A METALLIC SHELL

BACKGROUND OF THE INVENTION

This invention relates to an electrical connector to be mounted to a printed circuit board and, in particular, to an electrical connector of a thin type.

In a conventional electrical connector, especially, a receptacle for receiving a plug connector, an insulator block is formed with a rectangular fitting hole or a mating portion 2 for receiving the plug connector as a mating connector. A plurality of contacts 3 are fixed to the insulator block and arranged in a row in the rectangular fitting hole. The insulator block is covered with a metallic shell fitted onto an outer surface of the insulator block.

However, miniaturization of the electrical connector of this kind is demanded in order to small-size an electronic device using the connector. Especially, it is required reduce a height of the electrical connector on a printed circuit board equipped in a liquid crystal display of a personal computer.

In order to respond the demand, the insulator block is small-sized so that the wall defining the fitting hole is reduced in the thickness. However, this results in reduced strength of the wall defining the mating portion of the connector. Therefore, reduction of the size of the insulator block is limited because excessive small size may cause damage of the wall on connection and/or disconnection with the mating connector.

Another approach is known in the art where, taking into consideration that the lower surface of the electrical connector is disposed on the printed circuit board, the lower portion of the electrical connector is omitted to reduce the height of the electrical connector on the printed circuit board. However, the mating portion is opened at the lower side so that contacts are exposed toward the surface of the printed circuit board. Therefore, it is necessary to make a sufficient distance between the contacts and the printed circuit board so that the contacts are contaminated with or undesirably adhered to solder on a soldering process for connecting the electric connector and other parts onto the printed circuit board. Accordingly, sufficient reduction of size cannot be realized.

SUMMARY OF THE INVENTION

It is therefore, an object of this invention to provide an electrical connector which has a reduced size but does not have any problem in strength for connection and disconnection of a mating connector and in soldering process to a printed circuit board.

According to this invention, there is provided an electrical connector comprising: an insulator block having a long bar portion of a rectangular cross section and a pair of pillar portions projecting from the same surface of opposite end portions of the bar portion in a direction perpendicular to the bar portion; a plurality of contacts fixed to the bar portion and arranged in a row along a longitudinal direction of the bar portions and in a parallel with one another and with the pillar portions; and a metallic shell fitted onto the insulator block and having two flat plate portions extending from one to the other of the pillar portions in parallel with each other at a distance defined by a size of the pillar portions, the two flat plate portions and the pillar portions defining a mating hole for receiving a mating connector.

Figure 1:
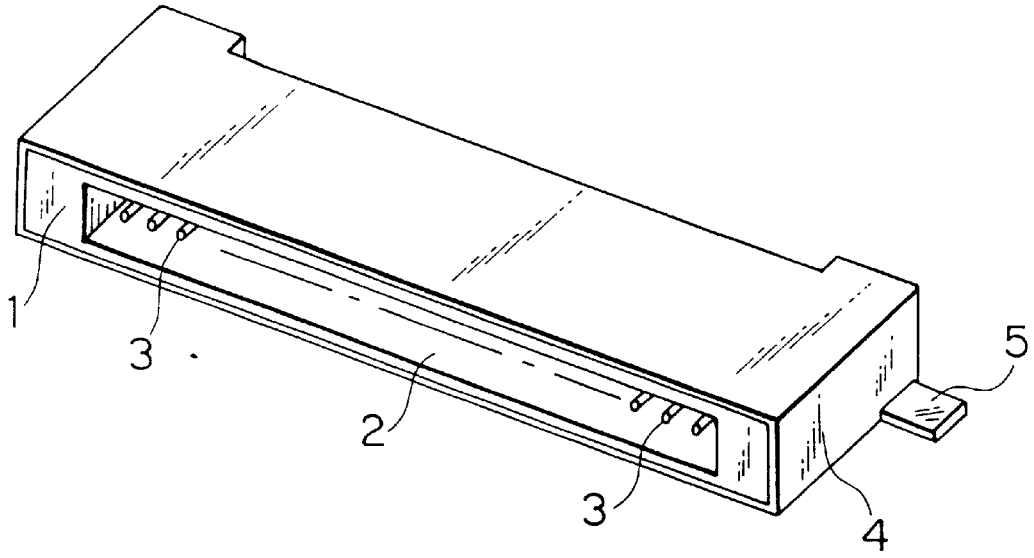
FIG. 1 PRIOR ART
FIG. 1 is a perspective view of a conventional electrical connector to be mounted to a printed circuit board.

DESCRIPTION OF THE PREFERRED EMBODIMENT:

Prior to description of the preferred embodiment, prior art electrical connectors will be described with reference to the drawing, so as to facilitate the better understanding of this invention.

Referring to FIG. 1, a conventional electrical connector for mounting to a printed circuit board comprises a insulator block 1. The insulator block 1 is formed with a rectangular fitting hole 2 in a front end portion for receiving a mating or plug connector. A plurality of contacts 3 are fixed to the insulator block 1 and have contact portions arranged in the rectangular fitting hole 2 into a row which is parallel with an upper and lower side surface of the insulator block 1. A metallic shell 4 is fitted on an outer peripheral surface of the insulator block 1. The insulator block 1 is provided with metallic fittings 5 (one is shown) projecting from lower edges of end surfaces thereof for reinforcement which also serve to ground the metallic shell 4.

The contacts 3 has terminal portions (not shown) extending from the insulator block 1 rearward, that is, in the direction opposite to the rectangular fitting hole 2. The terminal portions are bent towards downward so as to connect with a printed circuit board.

The electrical connector is mounted on the printed circuit board in the state that its lower side surface faces a surface of the printed circuit board.

The conventional electrical connector has the problems as described in the preamble.

Figure 2:
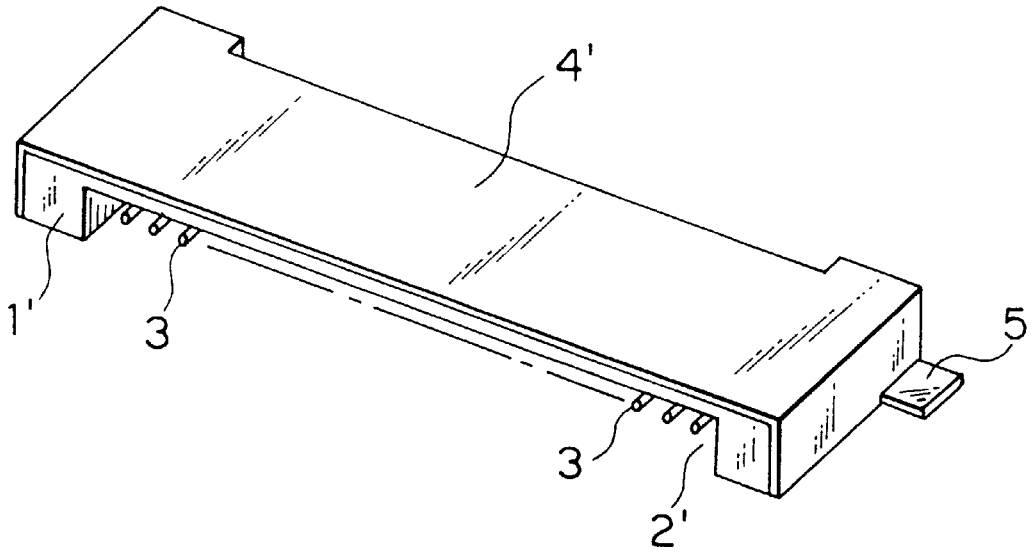
FIG. 2 PRIOR ART
FIG. 2 is a perspective view of another known electrical connector to be mounted to a printed circuit board.

Referring to FIG. 2, another prior art electrical connector also comprises an insulator block 1', a plurality of contacts 3, a metallic shell 4' and a metallic fittings 5. In comparison with one of FIG. 1, the lower wall portions of the insulator block 1 and the metallic shell 4 are omitted. Therefore, the mating portion is open downward as well as frontward as shown at 2' in FIG. 2.

The prior art electrical connector has also problems as described in the preamble.

Figure 3:
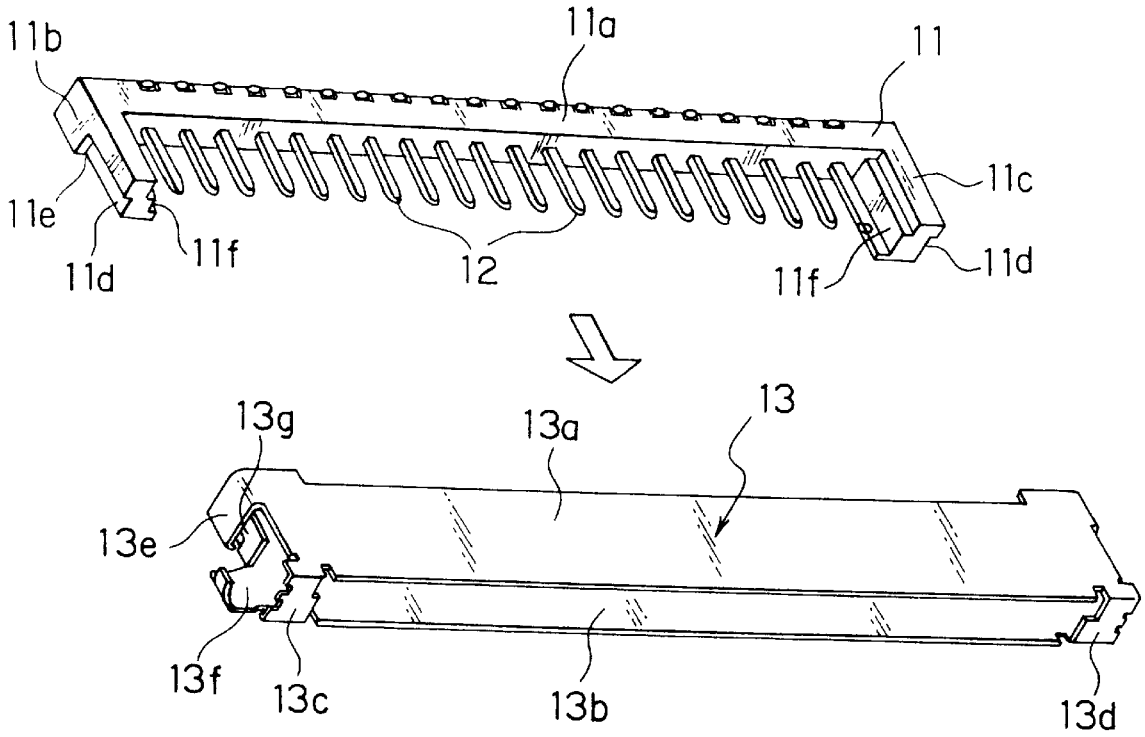
FIG. 3 is an exploded perspective view of an electrical connector to be mounted to a printed circuit board according to an embodiment of this invention.
Figure 4:
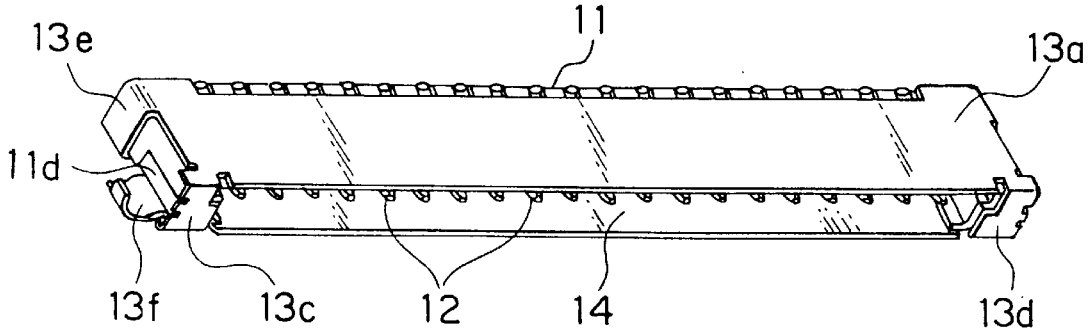
FIG. 4 is an assembled perspective view of the electrical connector shown in FIG. 3.

Now, referring to FIGS. 3 and 4, an electrical connector of an embodiment of this invention shown therein also comprises an insulator block 11, a plurality of contacts 12 fixed to the insulator block 11, and a metallic shell 13 fitted and fixed to the insulator block 11.

As shown in FIG. 3, the insulator block 11 consists of a bar portion 11*a* of a rectangular cross section and a pair of pillar portions 11*b* and 11*c* projecting from the same surface of opposite end portions of the bar portion 11*a* in a direction perpendicular to the bar portion 11*a*.

The plurality of contacts 12 are fixed to the bar portion 11*a* and extend in parallel with one another and with the pillar portions 11*b* and 11*c*. The contacts 12 are arranged in a row along a longitudinal direction of the bar portion 11*a*. The contact 12 have contact portions at the extended ends. The contacts 12 further have terminal portions (12*a* in FIG. 6) which project from the bar portion 11*a* in the opposite direction side of the bar portion 11*a*. The terminal portions are bend downward for connecting with the printed board.

Each of pillar portions 11*b* and 11*c* is formed with an engaging depression 11*d* and an engaging cutout 11*e* in an end surface of each of the pillar portion 11*b* and 11*c* for engaging the shell 13 therewith.

The shell 13 is formed of a metallic plate by blanking and bending process. Namely, the shell 13 has two long flat plate portions 13*a* and 13*b* and two bridge portions 13*c* and 13*d* which connect one to another of the long flat plate portions 13*a* and 13*b* at a front (in FIG. 3) of each end side thereof. As shown in FIG. 3, the two long flat plate portions 13*a* and 13*b* face each other at the distance decided by the length of the two bridge portions 13*c* and 13*d*. The shell 13 covers an outer peripheral surface of the insulator block 11 and the contacts 12. It is noted that the distance corresponds to the thickness of the insulator block 11.

The long flat plate portion 13*a* has bent portions 13*e* (only one is shown) at opposite ends in the longitudinal direction thereof for end walls of the shell 13. On the other hand, the other long flat plate portion 13*b* has reinforcement portions 13*f* (only one is shown) projecting sideward, and engagement portions 13*g* (only one is shown) bent to the inside of the bent portion 13*e* at the opposite ends thereof.

As indicated by an arrow in FIG. 3, the insulator block 11 having the contacts 12 is inserted into between the two long flat plate portions 13*a* and 13*b* which face each other. As a result, the electrical connector is assembled as shown in FIG. 4.

Figure 5:
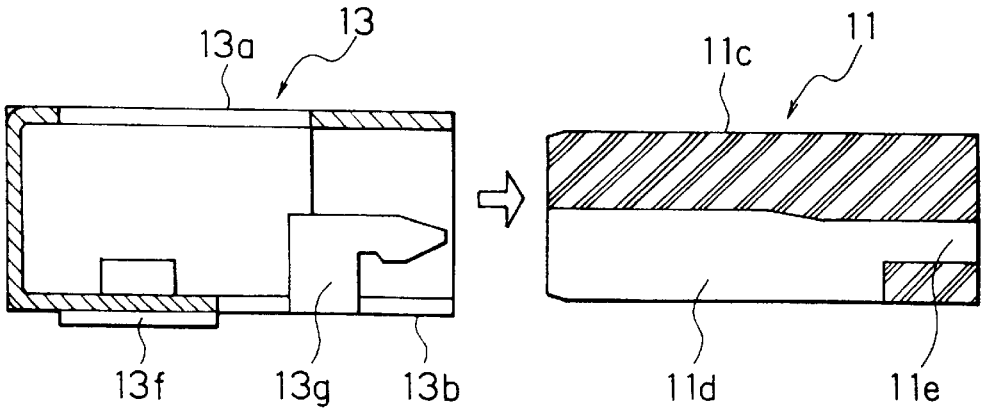
FIG. 5 is a sectional view of a state before assembling a shell and an insulating block of the electrical connector shown in FIG. 3.
Figure 6:
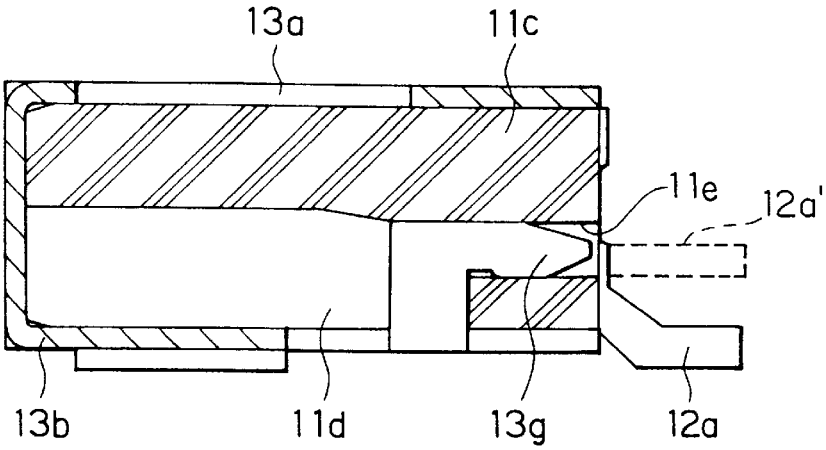
FIG. 6 is a sectional view of a state after assembling the shell and the insulating block of the electrical connector shown in FIG. 3.

Referring to FIGS. 5 and 6, engaging relations will be described between the engaging depression 11*d* and the engaging cutout lie of each of the pillar portions 11*b* and 11*c* and the engaging portion 13*g* of the shell 13.

As indicated by an arrow in FIG. 5, the shell 13 fits onto the insulator block 11. At first, the engaging portion 13*g* (bent as like an elbow) enters into the engaging depression 11*d* of each of the pillar portions 11*b* and 11*c*. Then, the engaging portion 13*g* slides along the engaging depression 11*d*, and is press-fitted into the engaging cutout 11*e* at last. Consequently, the shell 13 is installed and fixed to the insulator block 11.

In the assembled electrical connector shown in FIG. 4, the two bridge portions 13*c* and 13*d* of the shell 13 cover the front ends of the pillar portions 11*b* and 11*c*, respectively. The two long flat plate portions 13*a* and 13*b* and the pillar portions 11*b* and 11*c* defines a fitting hole 14 which receives a mating connector. The contacts 13 are arranged in a row in the fitting hole 14 and face directly to the two long flat plate portions 13*a* and 13*b*.

Referring to FIG. 3 again, each of the pillar portions 11*b* and 11*c* has step portions 11*f* at their inner surfaces facing each other so as to prevent from incorrect fitting of the mating connector into the fitting hole 14. The mating connector has end surfaces corresponding to the step portions 11*f*. Since the step portions 11*f* are not in a rotational symmetry to each other, the mating connector can not inversely be fitted into the fitting hole 14. Consequently, the mating connector is prevented from incorrect fitting into the electrical connector.

Figure 7:
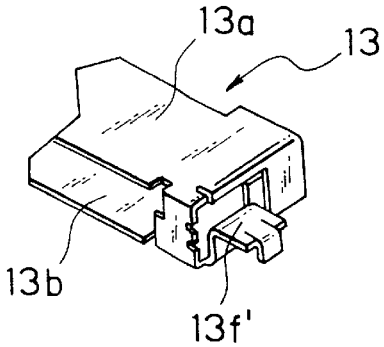
FIG. 7 is a partial perspective view of a modified shell of the electrical connector to be mounted to the printed circuit board according to the embodiment of this invention.

FIG. 7 is a modified shell 13 of the electrical connector to be mounted to the printed circuit board according to the embodiment of this invention. In the modification, the reinforcement portion 13*f* is deformed by a press machine to have a portion as shown at 13*f*' positioned at a level between the two long flat plate portions 13*a* and 13*b*. The modified shell is adopted in a mounting structure where the electrical connector is fitted in a connector receiving hole formed in a printed circuit board and is surface-mounted on the printed circuit board in a state that the electrical connector partially sinks in the printed circuit board. Needless to say, terminal portions 12*a* of the contacts 12 are deformed as shown by a dotted line 12*a*' in FIG. 6.

As apparent from the above description, the electrical connector according to this invention has a fitting hole for receiving a mating connector, which hole is defined by not insulator walls but a metallic shell. Therefore, it can be formed with a reduced size by the total thickness of the insulator walls defining the fitting hole in the conventional electrical connector. Further, the metallic shell has sufficient strength endurable against fitting of the mating connector. Moreover, the metallic shell protects the contacts in the fitting hole from undesired adhesion of solder during the soldering process for connecting the electrical connector to a printed circuit board.

What is claimed is:

1. An electrical connector comprising:

an insulator block having a long bar portion of a rectangular cross section and a pair of pillar portions projecting from the same surface of opposite end portions of said bar portion in a direction perpendicular to said bar portion, said pillar portions having engaging cutouts at opposite end surfaces, said insulator block being free of a side wall extending between said pair of pillar portions;

a plurality of contacts fixed to said bar portion and arranged in a row along a longitudinal direction of said bar portions and in parallel with one another and with said pillar portions; and a metallic shell press-fitted onto said insulator block from an engaging side of the insulator block for a mating connector, said shell having two flat plate portions extending from one to the other of said pillar portions in parallel with each other at a distance defined by a size of said pillar portions; said two flat plate portions covering touching portions of said plurality of contacts, said long bar portion, and said pair of pillar portions; said two flat plate portions and said pillar portions defining a mating hole for receiving said mating connector; said shell being formed with a pair of engaging portions which engage to said engaging cutouts, and said shell being fixedly mounted to said insulator block by engaging said engaging portions to said engaging cutout.

2. An electrical connector as claimed in claim 1, said electrical connector being mounted on a printed circuit, wherein said shell is formed with a reinforcement portion projecting therefrom, said reinforcement portion serves as a grounding terminal to be connected to a ground pattern on the printed circuit board.

3. An electrical connector as claimed in claim 1, wherein said pillar portions have step portions at inner surfaces facing each other, said step portions are out of a rotational symmetry to each other.

4. An electrical connector as claimed in claim 1, wherein said metallic shell has two bridge portions at opposite end portions to connecting between said two flat plate portions.

* * * * *